US008419594B2

(12) United States Patent
Motoyashiki

(10) Patent No.: US 8,419,594 B2
(45) Date of Patent: Apr. 16, 2013

(54) EXERCISE DEVICE FOR CORRECTING POSTURE

(76) Inventor: Hideki Motoyashiki, Minamimuro-gun (JP)

( * ) Notice: Subject to any disclaimer, the term of this patent is extended or adjusted under 35 U.S.C. 154(b) by 344 days.

(21) Appl. No.: 12/279,842

(22) PCT Filed: Dec. 15, 2006

(86) PCT No.: PCT/JP2006/325065

§ 371 (c)(1),
(2), (4) Date: Aug. 18, 2008

(87) PCT Pub. No.: WO2007/097102

PCT Pub. Date: Aug. 30, 2007

(65) Prior Publication Data

US 2010/0218772 A1 Sep. 2, 2010

(30) Foreign Application Priority Data

Feb. 19, 2006 (JP) ..... 2006-075601
Jul. 18, 2006 (JP) ..... 2006-196087

(51) Int. Cl.
*A63B 23/025* (2006.01)
*A63B 21/00* (2006.01)
*A63B 21/002* (2006.01)
*A61G 15/00* (2006.01)

(52) U.S. Cl.
USPC ..... 482/10; 482/91; 482/131; 482/907; 128/845

(58) Field of Classification Search ..... 482/49, 482/907, 10–11, 44, 79–80, 91, 131–132, 482/139–140, 148; 5/633–636, 624, 621–622; 128/97.1, 845; 601/39, 23; 602/17–18; 297/391–393; 446/391; 606/240; D21/662, D21/679, 684–686, 688–689
See application file for complete search history.

(56) References Cited

U.S. PATENT DOCUMENTS 1,869,460 A * 8/1932 Brand ..... 606/240
1,904,039 A * 4/1933 Bruder ..... 606/240
(Continued)

FOREIGN PATENT DOCUMENTS

JP 58-108820 U 7/1983
JP 59-33414 U 3/1984
(Continued)

OTHER PUBLICATIONS

International search report issued in corresponding PCT/JP2006/325065, dated Mar. 6, 2007.

(Continued)

*Primary Examiner* — Oren Ginsberg
(74) *Attorney, Agent, or Firm* — Rossi, Kimms & McDowell LLP

(57) ABSTRACT

It is intended to provide a posture-correcting exercise device (10) having a novel structure by which an effect comparable to traction can be easily established without resorting to use a large-scaled apparatus and which can be easily and conveniently operated and yet is expected as achieving effects of, for example, correcting spine distortion and reinforcing muscles supporting the spine to thereby fundamentally reduce the load on the spine when appropriately operated. To solve the above problem, the posture-correcting exercise device (10) has a chin rest portion, on which the chin of a user (34) is placed, at the upper end face and a setting face at the lower end face. The outer periphery of the setting face serves as a tilting face (26) in a curved shape. When the user (34) puts his/her chin on the chin rest portion, the device is tiltable at the setting face.

13 Claims, 11 Drawing Sheets

U.S. PATENT DOCUMENTS

| | | | | | |
|---|---|---|---|---|---|
| 2,056,767 | A | * | 10/1936 | Blath | 128/889 |
| D174,778 | S | * | 5/1955 | Smith | D6/601 |
| 3,003,815 | A | * | 10/1961 | Zinn | 297/118 |
| 3,756,594 | A | * | 9/1973 | Goodwin | 482/49 |
| 4,193,150 | A | * | 3/1980 | Vineberg | 5/632 |
| D257,105 | S | * | 9/1980 | Morris | D6/601 |
| 4,536,905 | A | * | 8/1985 | DeSantis | 5/636 |
| 4,705,030 | A | * | 11/1987 | Tepperberg | 606/240 |
| 4,829,613 | A | * | 5/1989 | Yon | 5/652 |
| 4,918,774 | A | * | 4/1990 | Popitz | 5/644 |
| 5,147,267 | A | * | 9/1992 | Kunewalder | 482/142 |
| 5,207,704 | A | * | 5/1993 | Shields | 606/240 |
| 5,261,420 | A | * | 11/1993 | Grillo | 5/655.9 |
| 5,337,427 | A | * | 8/1994 | Pagano et al. | 5/602 |
| 5,431,618 | A | * | 7/1995 | Levi | 482/142 |
| 5,474,513 | A | * | 12/1995 | Carlesimo et al. | 482/140 |
| 5,652,981 | A | * | 8/1997 | Singer-Leyton et al. | 5/631 |
| 5,727,267 | A | * | 3/1998 | Keilhauer | 5/636 |
| 5,795,276 | A | * | 8/1998 | Almeda | 482/142 |
| 5,937,460 | A | * | 8/1999 | Humphries | 5/640 |
| 5,971,890 | A | * | 10/1999 | Tyne | 482/10 |
| 6,052,847 | A | * | 4/2000 | Allyn et al. | 5/632 |
| D444,980 | S | * | 7/2001 | Mowat et al. | D6/601 |
| 6,349,437 | B1 | * | 2/2002 | Horning | 5/632 |
| 6,823,546 | B1 | * | 11/2004 | Hsu | 5/636 |
| 7,013,512 | B1 | * | 3/2006 | Hsu | 5/636 |
| 7,225,485 | B2 | * | 6/2007 | Binder | 5/644 |
| D579,706 | S | * | 11/2008 | Cox et al. | D6/601 |
| 7,707,668 | B2 | * | 5/2010 | Kloes et al. | 5/636 |
| 7,805,787 | B2 | * | 10/2010 | Wallis | 5/641 |
| 2004/0019972 | A1 | * | 2/2004 | Schecter et al. | 5/645 |
| 2007/0022537 | A1 | * | 2/2007 | Faustick | 5/655 |
| 2008/0271742 | A1 | * | 11/2008 | Maginness | 128/845 |
| 2009/0106904 | A1 | * | 4/2009 | Swarts et al. | 5/636 |
| 2009/0131973 | A1 | * | 5/2009 | Zacharias | 606/204 |
| 2011/0126843 | A1 | * | 6/2011 | Gamber et al. | 128/845 |

FOREIGN PATENT DOCUMENTS

| | | | |
|---|---|---|---|
| JP | 63-38509 | U | 3/1988 |
| JP | 6-38996 | A | 2/1994 |
| JP | 9-285479 | A | 11/1997 |
| JP | 3081698 | U | 11/2001 |
| JP | 2004-255140 | A | 9/2004 |
| JP | 2005-287833 | A | 10/2005 |

OTHER PUBLICATIONS

English translation of International Search Report issued in corresponding PCT/JP2006/325065, dated Aug. 28, 2008.

* cited by examiner

EXERCISE DEVICE FOR CORRECTING POSTURE

This application is a U.S. National Phase Application of PCT International Application PCT/JP2006/325065 filed on Dec. 15, 2006 which is based on and claims priority from JP 2006-075601 filed on Feb. 19, 2006 and JP 2006-196087 filed on Jul. 18, 2006, the contents of which is incorporated herein in its entirety by reference.

TECHNICAL FIELD

The present invention relates to an exercise device for correcting posture, adapted to correcting spinal distortion and to attaining correct posture.

BACKGROUND ART

As the designation "spinal column" suggests, the human spine function as a pillar supporting the center of the body. It is formed by a number of vertebrae which are stacked in a manner similar to a mosaic with the vertebral disks between them. A spinal cavity is formed in each of the vertebrae which make up the spinal column, and with the vertebrae stacked to constitute the spinal column, the spinal cavities formed in the individual vertebrae will be aligned in a row. As a result, there is formed within the spinal column the spinal canal, which contains the spinal cord.

With the spinal column articulated as described above, intervertebral foramina present between each pair of stacked vertebrae allow the nerves which branch from the spine to pass out. The nerves which pass out from the spinal column through the intervertebral foramina lead to every part of the body, from the muscles of the hands and feet to the internal organs.

Consequently, if the spine becomes distorted, constriction may occur between vertebrae, causing the disk between two vertebrae to stick out. This in turn can exert pressure on nerve roots passing through the surrounding area, resulting in symptoms such as pain or tingling of the hands, feet, lower back, shoulders, or head.

Spinal traction is one known treatment for relieving such symptoms. Traction involves using a device such as that disclosed, for example, in Patent Citation 1, in order to pull and stretch the spinal column in the cephalocaudal direction.

However, traction methods involve the use of large-scale apparatus such as electric motors and their power supply devices, control devices and so on, so it is no easy matter for patients to purchase such devices individually. Moreover, even if a patient is able to purchase such a device, they are often complicated to operate and entail the application of vigorous external force under power from an electric motor, making technical knowledge a prerequisite for proper control and operation. It is difficult to conceive of an individual patient being able to operate such a device.

Accordingly, conventional treatment through traction methods required patients with physical problems to visit a hospital or other location equipped with specialized traction equipment. This imposed a significant burden on the patient and made it difficult to receive traction treatment on a frequent basis, and a resultant problem was that in many cases it was difficult for patients to receive optimal treatment.

Since load placed upon the spine represents an additional cause of distortion of the spine, if no measures are taken to somehow fundamentally reduce the load on the spine, even if the spacing between the vertebrae is expanded through traction they will tend to quickly return to their original state. For this reason, to date it has proven extremely difficult to fundamentally relieve patient symptoms that are caused by pressure on the nerves in association with constriction between vertebrae as described above.

Patent Citation 1: JP-A-6-38996

DISCLOSURE OF THE INVENTION

Problem the Invention Attempts to Solve

With the foregoing in view, it is accordingly one object of the present invention to provide an exercise device of novel structure for correcting posture, which conveniently affords an effect comparable to traction but without the need for a large-scale apparatus.

It is another object of the present invention to provide an exercise device of novel design for correcting posture, that despite its simplicity and convenience, when operated appropriately makes it possible to correct spinal distortion or to reinforce the muscles supporting the spine, and to thereby fundamentally reduce load on the spine.

Means for Solving the Problem

The above and/or optional objects of this invention may be attained according to the modes of the invention described hereinbelow. The following elements employed in each mode of the invention may be adopted in any possible optional combinations.

The posture-correcting exercise device of the present invention includes: at an upper end face thereof a chin rest portion upon which a user rests a chin; at a lower end face thereof a setting face, an outer periphery of the setting face defining a tilting face of curved shape so that the user is able to tilt at the setting face with the chin resting on the chin rest portion.

With the posture-correcting exercise device of this design according to the present invention, since the chin rest portion is formed at the upper end face it is possible for the user, for example, while sitting in a chair, to rest the chin on the chin rest portion of the posture-correcting exercise device which has been positioned on a desk so that the user's body weight bears down on the posture-correcting exercise device with his or her chin resting on the chin rest portion; the reaction force produced thereby will act on the head area of the user via the chin of the user. As a result, the user's head will experience tensioning in the direction of action of the reaction force, making it possible to extend the spine in the cephalocaudal direction in a manner analogous to conventional traction therapy.

Accordingly, with the posture-correcting exercise device of the present invention it will be possible to achieve effects comparable to traction, without the use of a large-scale apparatus.

Moreover, with the posture-correcting exercise device of the above design according to the present invention, since the outer periphery of the setting face defines a tilting face of curved shape which allows the device to tilt at the setting face with the chin of the user resting on the chin rest portion, when the user shifts his or her body weight onto the posture-correcting exercise device with his or her chin resting on the chin rest portion (for example, with the user sitting in a chair with his or her chin resting on the chin rest portion of the posture-correcting exercise device which has been positioned on a desk) while tilting the posture-correcting exercise device in the forward and back directions, the user will need to adopt the posture required for maintaining the posture-correcting exercise device in the tilted state. By so doing it will be possible for the spine to assume its natural curvature. It will be possible to correct distortion of the spine as a result.

As the user attempts to maintain the posture-correcting exercise device in a tilted state, it will be possible for load to bear on the muscles used at this time, specifically, on the muscles responsible for maintaining the natural curvature of the spine. It will be accordingly possible to train the muscles responsible for maintaining the natural curvature of the spine. As a result, it will be possible to fundamentally reduce the load on the spine.

Consequently, with the posture-correcting exercise device of the present invention, it will be possible to correct spinal distortion simply and conveniently, while at the same time training the muscles that support the spine, and to thereby fundamentally reduce the load on the spine.

In particular, since no reaction motion is required when using the posture-correcting exercise device of the present invention, it will be possible to comfortably train the muscles required to support the spine in a state of natural curvature, without adverse effects on the afflicted region of the spine.

Furthermore, it is possible for the user to achieve good left-right balance of the muscles that support the spine by tilting the posture-correcting exercise device in the left and right directions. Specifically, by tilting the posture-correcting exercise device to either the left or right, it will be possible for the user to intensively train the muscles on either the left or right. Thus, in cases of poor balance between muscles on the left and right, it will be possible to train the weaker muscles to a greater extent than the stronger muscles, and to thereby achieve good balance in training of muscle strength on the left and right sides. It will be possible to correct distortion of the spine (particularly lateral spinal curvature) as a result.

In the present invention, the chin rest portion may be formed over the entirety of the upper end face or over a portion thereof. While the chin rest portion of the invention may have a fixed design, in preferred practice it will have a detachable design. By so doing it will be possible, for example, to prepare a suitable number of chin rest portions differing in size, thickness, shape and so on, and to appropriately replace the chin rest portion depending on user physique, method of use, and other considerations, for different users or for different methods of use by a given user. As a result, it will be possible to address different user physiques, methods of use, and so on.

In the present invention, the tilting face may be formed along the entire perimeter of the outer periphery of the setting face, or localized at one or several locations at the perimeter of the outer peripheral edge. Furthermore, in the present invention, the tilting face may have unchanging curvature or varying curvature from the lower end face towards the outer peripheral face. Moreover, at the outer peripheral edge of the lower end face, the tilting face may have unchanging curvature or varying curvature in the circumferential direction. Furthermore, in the present invention, it is acceptable for the tilting face to be formed on at least the outer periphery of the setting face, and as will be discussed later a flat face may be present at the center of the setting face; however, it is also acceptable for the setting face in its entirety, including its center, to defined by a curving face so that the entire setting face functions as the tilting face.

Furthermore, in the posture-correcting exercise device of the present invention, it is preferable that a flat face is formed in a center section of the setting face, and an outside peripheral edge of the flat face is curved with beveled contours so as to define the tilting face. By so doing it will be possible for the user to easily apply his or her weight to the posture-correcting exercise device with the chin resting on the chin rest portion. For example, in particular it will be easier for the user to assume a stable posture with the chin resting on the chin rest portion positioned on the center axis above the setting face in the vertical direction with the setting face of the posture-correcting exercise device positioned resting on a supporting surface such as a flat desk, and the posture-correcting exercise device positioned upright approximately in the vertical direction in the manner discussed later; and it will be easier to achieve strong traction force thereby.

Where a design like the above is employed, in preferred practice the flat face that has been formed in the center section of the setting face will extend approximately orthogonal to the center axis that extends in the vertical direction (height direction) through the posture-correcting exercise device. By so doing it will be possible to advantageously avoid wobble of the posture-correcting exercise device when the user's weight is shifted onto the posture-correcting exercise device with the chin resting of the chin rest portion. As a result, it will be possible to stabilize the posture-correcting exercise device in the upright position with body weight shifted onto the posture-correcting exercise device.

Moreover, where a design like the above is employed, the "curve with beveled contours" may be any outwardly convex curve, and is not limited to a curve of rounded contours (arc contour) with unchanging curvature. The curving section need not have unchanging curvature in its cross sectional shape or in the circumferential direction.

In the posture-correcting exercise device of the present invention, the setting face will preferably have at its outer periphery a curving outside peripheral edge that is outwardly convex in a circumferential direction, with the curving outside peripheral edge defining the tilting face. By so doing it will be possible for the posture-correcting exercise device to move along the tilting face (the curving outside peripheral edge of the setting face). As a result, it will be possible for the user not just to move his or her body in a simple motion of rocking forward and back or left and right, but additionally to twist the body while inclined forward or backward.

Consequently, where a design like the above is employed, it will be possible to increase the number of possible exercise variations using the posture-correcting exercise device, and as a result to more advantageously accomplish correction of spinal distortion and training of the muscles that support the spine.

Moreover, where a design like the above is employed, it will be preferable that wherein the curving outside peripheral edge is formed over a length no more than halfway in a circumferential direction in the outer periphery of the setting face; and a straight outer periphery is formed so as to extend in a chord direction of the curving outside peripheral edge. By so doing, it will be possible to advantageously achieve motion along the circumferential direction of the curving outside peripheral edge with the posture-correcting exercise device tilted towards the curving outside peripheral edge side; and additionally to advantageously achieve stable tilting of the posture-correcting exercise device in a direction orthogonal to the straight outer periphery.

Specifically, simply by virtue of forming the curving outside peripheral edge it will be difficult to stabilize tilting of the posture-correcting exercise device in a direction orthogonal to the chord direction of the curving outside peripheral edge; but if a straight outer periphery is formed extending in a chord direction of the curving outside peripheral edge as described above, it will be possible to stabilize tilting of the posture-correcting exercise device in a direction orthogonal to the chord direction of the curving outside peripheral edge.

Consequently, it will be possible to stabilize the posture-correcting exercise device when using it to perform various exercises, and thus to advantageously achieve the intended effects of the exercises.

Moreover, where a straight outer periphery is formed on the setting face in this way, it will be preferable for the straight outer periphery to curve with beveled contours as well. By so doing, when for example the posture-correcting exercise device is used while positioned on a desk, it will be possible to vary the section of the straight outer periphery which contacts the desk depending on the condition of tilt of the posture-correcting exercise device, as compared with the case where the straight outer periphery does not curve with beveled contours. As a result, it will be possible to avoid the problem of slipping of the posture-correcting exercise device when tilting the posture-correcting exercise device in a direction orthogonal to the straight outer periphery.

In the posture-correcting exercise device of the present invention, it is preferable to form a slot that extends in a straight line on the setting face. By so doing, even if the posture-correcting exercise device should happen to slip, for example, when the posture-correcting exercise device is tilted while body weight shifted onto it, the slot will catch on the edge of the desk etc. and prevent the posture-correcting exercise device from slipping further. As a result, it will be possible to advantageously avoid an accident caused by slipping of the posture-correcting exercise device.

Furthermore, in the posture-correcting exercise device of the present invention, it is preferable to provide a height adjusting mechanism for adjusting the vertical position of the chin rest portion from the setting face. By so doing it will be possible to advantageously accommodate different user physique, methods of use, and so on.

Such a height adjusting mechanism may be designed, for example, to permit adjustment in multiple steps through insertion of a pin into any of a number of engagement holes, or to make the height to adjustable to any desired level by varying the threading position of a screw.

Moreover, in the posture-correcting exercise device of the present invention, it is preferable to form a recess for accommodating the chin of the user in the chin rest portion. By so doing, it will be possible to prevent the chin from slipping out of position with respect to the chin rest portion when the user tilts the posture-correcting exercise device with the chin resting in the chin rest portion, and to thereby advantageously avoid wobbling of the posture-correcting exercise device when the user shifts his or her body weight onto the posture-correcting exercise device. As a result, it will be possible to perform the intended exercises with stability and to advantageously achieve the effect by performing such exercises. It will also be possible to advantageously avoid accidents resulting from the chin slipping out of position with respect to the chin rest portion.

Where the design described above is employed, it will be preferable for the chin rest portion and the recess to be positioned on the same center axis. By so doing it will be possible to more advantageously avoid wobbling of the posture-correcting exercise device with the body weight of the user shifted onto the posture-correcting exercise device.

The "recess" mentioned in the design described above may have perforated form or furrowed form.

In the posture-correcting exercise device of the present invention, it is preferable for the setting face to be subjected to anti-slip processing. By so doing, it will be possible to advantageously prevent the posture-correcting exercise device from slipping while the posture-correcting exercise device is tilted.

In the present invention, anti-slip processing can be accomplished advantageously, for example, by applying to the setting face a material having slip resistance to the surface on which the posture-correcting exercise device will be placed, or by coating the setting face with a material having slip resistance to the surface on which the posture-correcting exercise device will be placed or with a liquid containing such material. It would of course be possible also to form the posture-correcting exercise device per se from a material having slip resistance to the surface on which the posture-correcting exercise device will be placed, to subject the setting face to a roughening process, or the like.

Furthermore, in the posture-correcting exercise device of the present invention it is preferable to form a grip portion for the user to grasp with the hands. By so doing, it will be possible for the user, while gripping the grip portion with the hands, to shift body weight onto the posture-correcting exercise device or to tilt the posture-correcting exercise device with body weight shifted onto it. As a result, it will be possible to achieve greater stability of the posture-correcting exercise device in the upright position and in the tilted position during exercise using the posture-correcting exercise device.

In the present invention, the grip portion may be constituted through direct formation on the posture-correcting exercise device itself, or constituted by a component separately attached to the posture-correcting exercise device.

In the posture-correcting exercise device of the present invention, the height dimension from the setting face to the chin rest portion will preferably be larger than the dimension in all directions orthogonal to the height direction. By so doing, when the user tilts the posture-correcting exercise device with the chin resting on the chin rest portion, it will be possible for the user to easily grasp the posture-correcting exercise device directly with the hands or to tuck it between both arms, for example. As a result, it will be possible to achieve greater stability of the posture-correcting exercise device in the upright position and in the tilted position during exercises using the posture-correcting exercise device.

Furthermore, in the posture-correcting exercise device of the present invention, it will be preferable to provide a separate support stand having a recess against which the setting face is positioned in tiltable contact. By so doing it will be possible to define, within the recess formed in the support stage, a range of allowable tilt of the posture-correcting exercise device. As a result, it will be possible to prevent excessive tilting of the posture-correcting exercise device and to stabilize the tilting condition of the posture-correcting exercise device during exercises using the posture-correcting exercise device. Moreover, by giving the support stage heavier weight, it will be possible to prevent slipping during exercises using the posture-correcting exercise device and to stabilize the tilting condition of the posture-correcting exercise device.

EXPLANATION OF SYMBOLS

10: posture-correcting exercise device; 22: pad; 24: setting face; 26: first outwardly convex curving face; 34: user

BEST MODE FOR CARRYING OUT THE INVENTION

In order to provide a more specific understanding of the present invention, the embodiments of the invention will be described in detail below with reference to the accompanying drawings.

Figure 1:
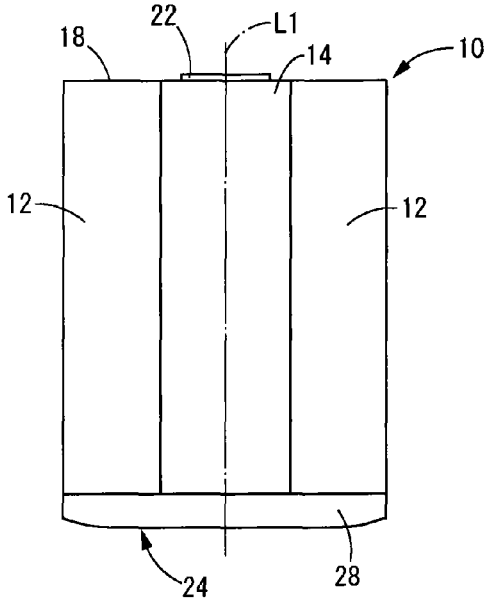
[FIG. 1] Front view depicting a posture-correcting exercise device according to a first embodiment of the present invention.
Figure 2:
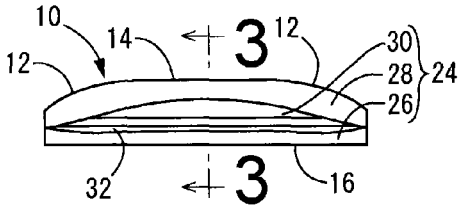
[FIG. 2] Bottom view of the posture-correcting exercise device.
Figure 3:
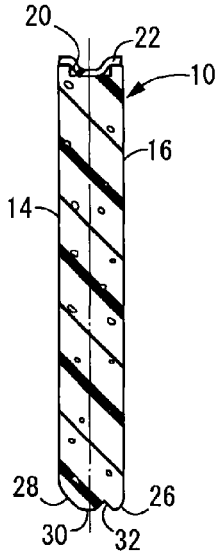
[FIG. 3] Sectional view taken along line 3-3 in FIG. 2.

Referring first to FIGS. 1 to 3, there is depicted a posture-correcting exercise device 10 according to a first embodiment of the present invention. This posture-correcting exercise device 10 is formed so as to extend with generally unchanging cross section along a center axis: L1, and has a thick elongated plate shape overall. Specifically, in this embodiment, the posture-correcting exercise device 10 has a dimension in its lengthwise direction (the direction of extension of the center axis: L1), which is also the vertical direction (height direction) during use, that is sufficiently greater in length than that in all directions orthogonal to the lengthwise direction (i.e. the width direction and the thickness direction).

The posture-correcting exercise device 10 of this embodiment is made of expanded resin. However, the material for producing the posture-correcting exercise device 10 is not limited to expanded resin, and it would be possible to use instead a metal material such as aluminum alloy or steel; a wood material such as specialty wood from Mie Prefecture or Kumano cedar; synthetic resins; fiber-reinforced resins; or carbon fibers for example. However, it is preferable for materials selection to be made in consideration of reducing the weight of the posture-correcting exercise device 10. This will make the posture-correcting exercise device 10 easier to carry. It would of course be possible to reduce the weight of the posture-correcting exercise device 10 by giving the posture-correcting exercise device 10 a hollow interior as well.

Furthermore, the posture-correcting exercise device 10 of this embodiment has on one side thereof in the thickness direction (the vertical direction in FIG. 2) sloped faces 12, 12 situated to either side in the width direction and describing an arc as they descend towards the outside from the medial section in the width direction. Thus, as depicted in FIG. 2, the posture-correcting exercise device 10 of this embodiment will have a shape that, in longitudinal projection, is convex to one side in the direction of its thickness. In this embodiment, the face at one side in the thickness direction and lying between the pair of descending sloped faces 12, 12 having the curving shape described above (hereinafter denoted as the narrow face 14) is defined by a flat surface approximately parallel to the face at the other side in the thickness direction (hereinafter denoted as the wide face 16) and connecting smoothly at its widthwise edges to the respective curving sloped faces 12.

Furthermore, in this embodiment, a first end face in the lengthwise direction of the posture-correcting exercise device 10 (hereinafter denoted as the chin rest end face 18, which functions as the chin rest portion) is formed so as to extend in a direction approximately orthogonal to the center axis: L1 of the posture-correcting exercise device 10. A recess 20 which opens with a circular cross section is formed in the chin rest end face 18 of the embodiment; in this embodiment in particular, the center of the recess 20 is situated on the center axis: L1 of the posture-correcting exercise device 10.

Additionally, in this embodiment, a pad 22 is attached to the chin rest end face 18 so as to cover the opening section of the recess 20; in this embodiment in particular, the pad 22 is attached at the bottom face of the recess 20 as well. The surface of the pad 22 in the section thereof covering the opening of the recess 20 is thereby constituted as a concavely curving face. No particular limitation is imposed on material from which the pad 22 provided it can function as a material for providing cushioning when the user 34 (see FIG. 4) places his or her chin on the pad 22 and positions the chin within the recess 20 as will be discussed later; it would be possible to use urethane, rubber, or cloth for example.

Furthermore, on the other end face in the lengthwise direction of the posture-correcting exercise device 10 (hereinafter denoted as the setting face 24) there is formed a first outwardly convex curving face 26 produced by rounding off the corner of the other side in the thickness direction, to form an outwardly convex contour. Specifically, in this embodiment, the first outwardly convex curving face 26 is formed at the outside edge section of the setting face 24, in a section thereof extending in a straight line in the width direction (the left-right direction in FIG. 2) of the posture-correcting exercise device 10; in this embodiment in particular, the first outwardly convex curving face 26 extends along the entire width of the posture-correcting exercise device 10.

Additionally, in this embodiment there is formed a second outwardly convex curving face 28 produced by rounding off the corner of the first side of the setting face 24 in the thickness direction to form an outwardly convex contour. In this embodiment, because the narrow face 14 and the pair of sloped faces 12, 12 have been formed on the first side of the posture-correcting exercise device 10 in the direction of its thickness, the second outwardly convex curving face 28 produced by rounding off the corner to create an outwardly convex contour as described above will having outwardly convex curving contours in the circumferential direction; in this embodiment in particular, the second outwardly convex curving face 28 will be formed over a length no more than halfway around in the circumferential direction. By so doing, the first outwardly convex curving face 26 in the embodiment will be defined so as to extend in the direction of a chord of the second outwardly convex curving face 28.

Furthermore, in this embodiment, a flat face 30 extending approximately parallel to the chin rest end face 18 is formed on the setting face 24 so as to be situated between the first outwardly convex curving face 26 and the second outwardly convex curving face 28. In other words, in this embodiment, the flat face 30 is formed on the center section of the setting face 24 by imparting a beveled curve to the outside peripheral edge of the setting face 24 which, like the chin rest end face 18, was a flat surface at the outset, through formation of the first outwardly convex curving face 26 and the second outwardly convex curving face 28. As will be apparent from the fact that the flat face 30 is approximately parallel to the chin rest end face 18, the flat face 30 in this embodiment will be defined so as to extend in a direction approximately orthogonal to the center axis: L of the posture-correcting exercise device 10.

Moreover, in this embodiment a slot 32 that extends in a straight line across the entire width of the posture-correcting exercise device 10 is formed in the setting face 24. The slot 32 of this embodiment has a shape that gradually widens out from the bottom side towards the open end side in the direction of its depth.

Further, in this embodiment the setting face 24 is coated with silicone resin. This serves to prevent the posture-correcting exercise device 10 from slipping when the posture-correcting exercise device 10 is used in the manner described below.

Figure 4:
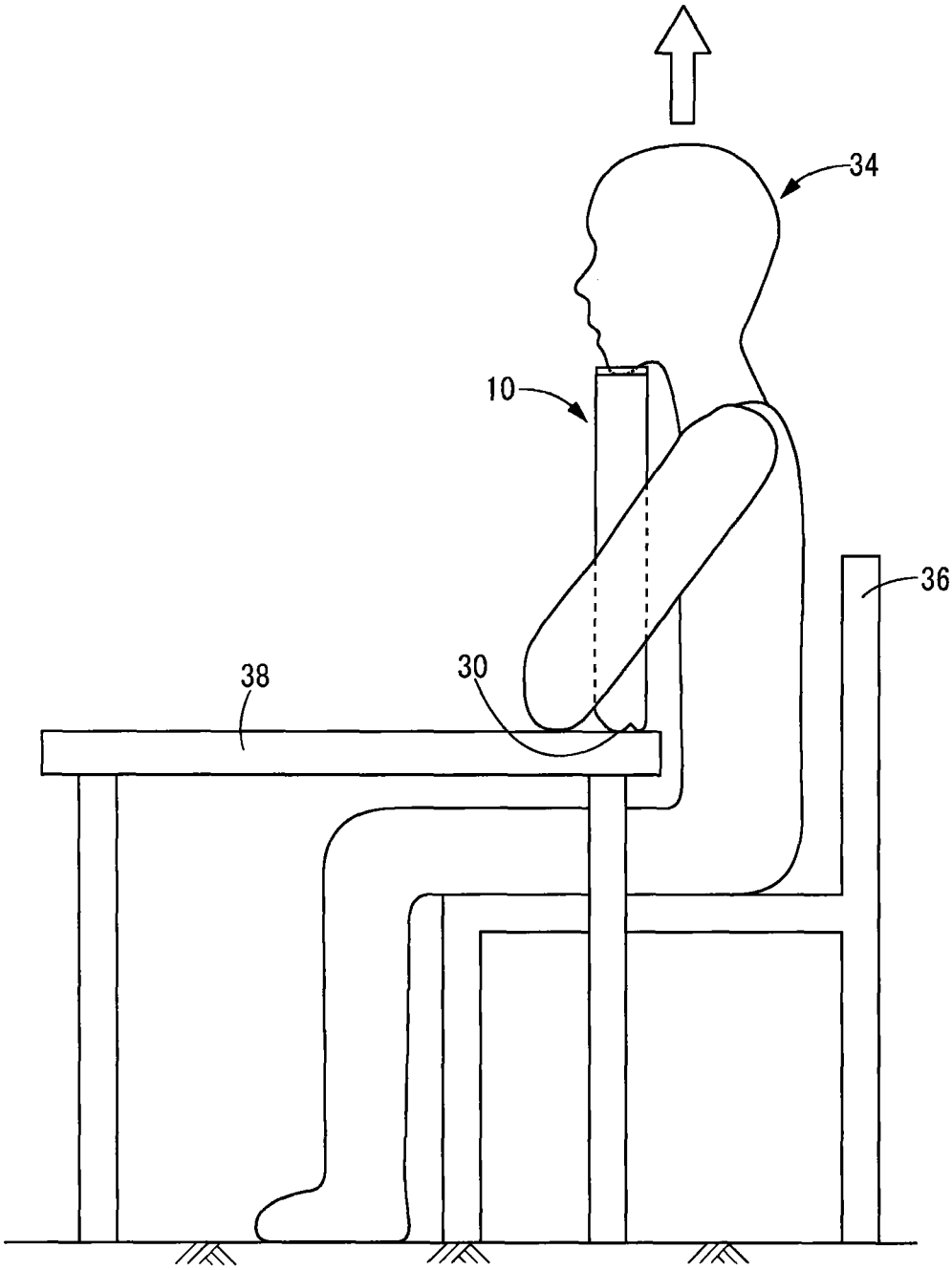
[FIG. 4] Side view illustrating a method of using the posture-correcting exercise device of the embodiment.

Next, a method for using the posture-correcting exercise device 10 having the above design will be described. Referring first to FIG. 4, the user 34 sits in a chair 36 facing a desk 38, and with the flat face 30 on the setting face 24 of the posture-correcting exercise device 10 positioned on the top of the desk 38 such that the narrow face 14 (specifically, the second outwardly convex curving face 28) is situated towards the opposite side (the side opposite where the user 34 is sitting), places his or her chin against the lower face of the recess 20 via the pad 22.

Then, with the user 34 sitting in the chair 36 with his or her chin resting against the lower face of the recess 20 via the pad 22 of the posture-correcting exercise device 10 which has been positioned on the desk 38 in this way, the user 34 must pre-adjust the height of the chair 36 and/or the desk 38 in such a way that his or her spinal column is pulled in the cephalocaudal direction (the direction of the arrow in FIG. 4).

By resting his or her chin against the lower face of the recess 20 via the pad 22 of the posture-correcting exercise device 10 thereby pulling the spinal column of the user 34 in the cephalocaudal direction (the direction of the arrow in FIG. 4) in the above manner, the user 34 will be able as a result to achieve benefits comparable to conventional traction therapy.

In particular, since it is possible to use the posture-correcting exercise device 10 of this embodiment while sitting in the chair 36 facing the desk 38, it will be possible to use the device during other such daily activities, such as while at the computer or while reading for example. As a result, the burden on the patient with regard to location, time, and so on can be dramatically reduced.

Additionally, since the posture-correcting exercise device 10 of the embodiment is intended to be used with the user 34 resting his or her chin against the lower face of the recess 20 via the pad 22 after having first adjusted the device to the proper height, it will be possible to make the user 34 aware of correct posture and to avoid poor posture in the course of daily activities.

In this embodiment, because the recess 20 is located on the same center axis as the posture-correcting exercise device 10, it will be possible to prevent wobble of the posture-correcting exercise device 10 when the user 34 shifts his or her body weight onto the posture-correcting exercise device 10 in its lengthwise direction (the direction of extension of the center axis: L1).

In this embodiment in particular, because the flat face 30 on the setting face 24 of the posture-correcting exercise device 10 is approximately orthogonal to the center axis: L1 of the posture-correcting exercise device 10, it will be possible to position the posture-correcting exercise device 10 upright on the desk 38, thereby more advantageously preventing wobble of the posture-correcting exercise device 10 when the user 34 shifts his or her body weight onto the posture-correcting exercise device 10.

Figure 5:
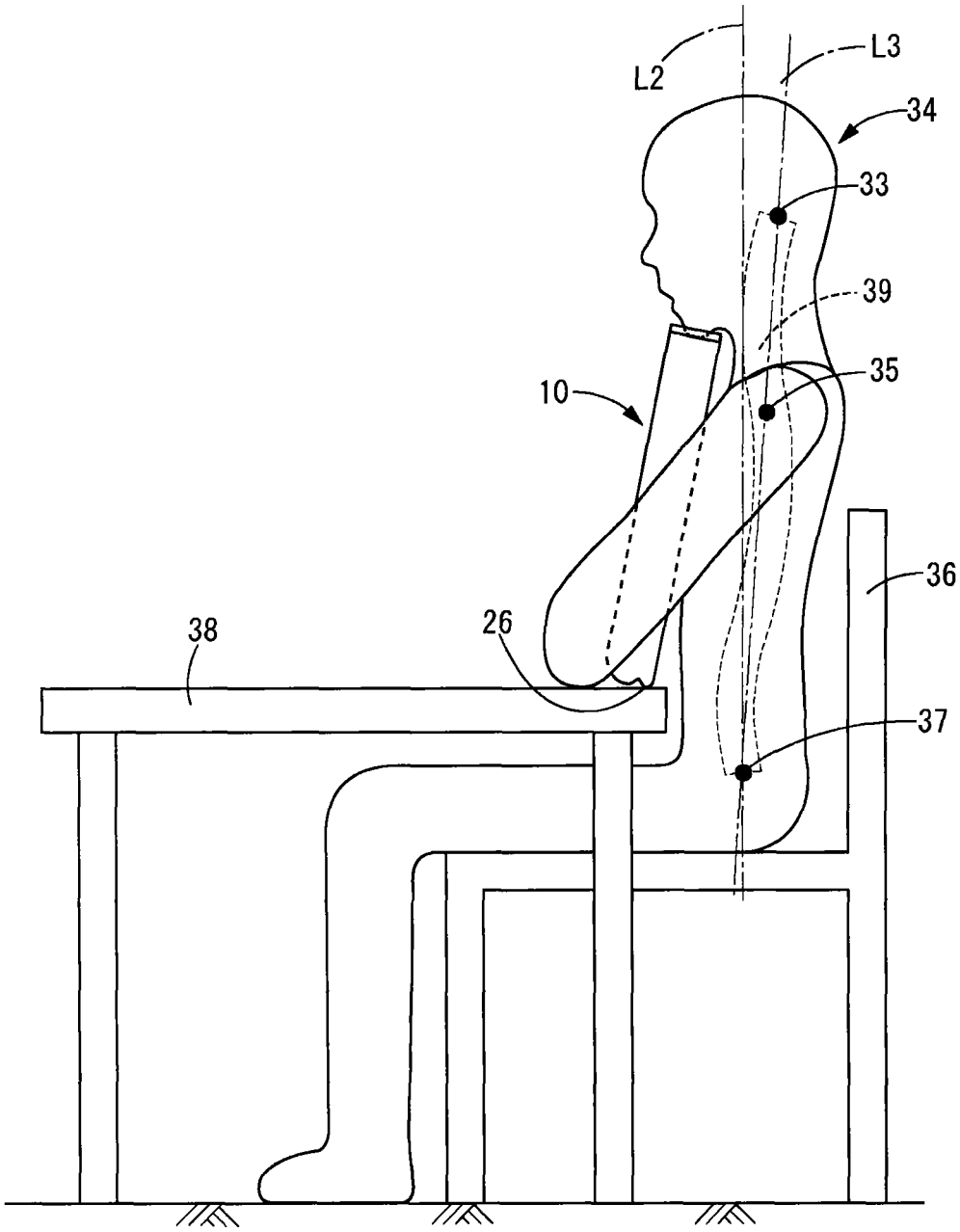
[FIG. 5] Side view illustrating another method of using the posture-correcting exercise device of the embodiment.

Moreover, the posture-correcting exercise device 10 having the design discussed above can be used not only by simply resting the chin against the lower face of the recess 20 via the pad 22 as described previously, but also by the user 34 tilting the device forward and backward. As a specific example, with the first outwardly convex curving face 26 situated towards the user 34 and the chin of the user 34 resting on the lower face of the recess 20 via the pad 22 as depicted in FIG. 4, if the user 34 now tilts the posture-correcting exercise device 10 towards himself or herself, the first outwardly convex curving face 26 of the setting face 24 of the posture-correcting exercise device 10 will come into contact against the top of the desk 38 as depicted in FIG. 5, inducing the user 34 to adopt a recurved posture with the chin tucked in and the face diagonally downward. By so doing, the ear hole 33, the center 35 of the shoulder, and the center 37 of the hip of the user 34 will be positioned along a single straight line: L3 that is inclined rearward past a straight line: L2 that extends in the vertical direction. As a result, the lumbar region and the cervical region of the spinal column 39 will curve convexly forward, while the thoracic region of the spinal column 39 will curve convexly rearward, producing the natural shape of the spine.

To carry out such an exercise, it will be necessary to either use a posture-correcting exercise device that is larger in the lengthwise direction (height direction) than the posture-correcting exercise device 10 intended to be used by simply shifting body weight onto it, or by adjusting the height of the chair 36 and/or the desk 38, so that when the user 34 assumes a recurved posture with the chin tucked in and the face diagonally downward, the ear hole 33, the center 35 of the shoulder, and the center 37 of the hip of the user 34 will be positioned along a single straight line: L2.

With the posture-correcting exercise device 10 tilted rearward (towards the user 34) as depicted in FIG. 5, the necessary muscles for supporting the natural shape of the spine must be employed in order to maintain the posture-correcting exercise device 10 in a rearward-tilted state, whereas with the posture-correcting exercise device 10 not tilted (i.e. in the upright position) as depicted in FIG. 4, the device is used without concentration on the muscles needed to produce the natural shape of the spine.

Consequently, through repeated rearward tilting of the posture-correcting exercise device 10 and returning it to the original upright position, the user 34 will be able to repeatedly tense and relax the necessary muscles to support the natural shape of the spine, and the necessary muscles to support the natural shape of the spine will be trained as a result. Through such training of the necessary muscles to support the natural shape of the spine, it will be possible to reduce the load on the spine.

This kind of method of use of the posture-correcting exercise device 10 will be effective in correcting hunch (also called slouching). By using the posture-correcting exercise device 10 in this way, it will be possible to attain correct posture with the ear hole, the center of the shoulder, and the ankle aligned on a straight line when standing up.

Figure 6:
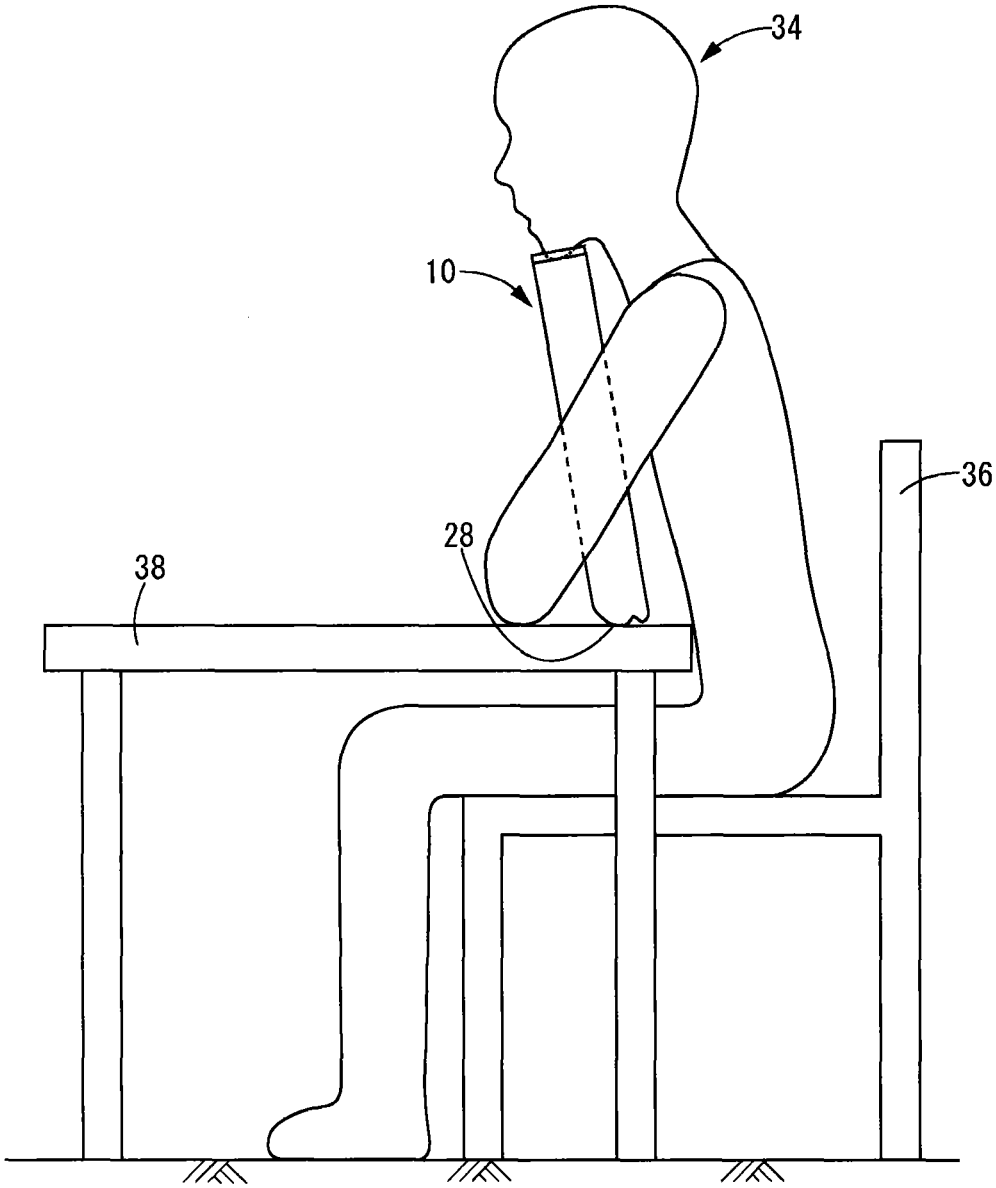
[FIG. 6] Side view illustrating yet another a method of using the posture-correcting exercise device of the embodiment.
Figure 7:
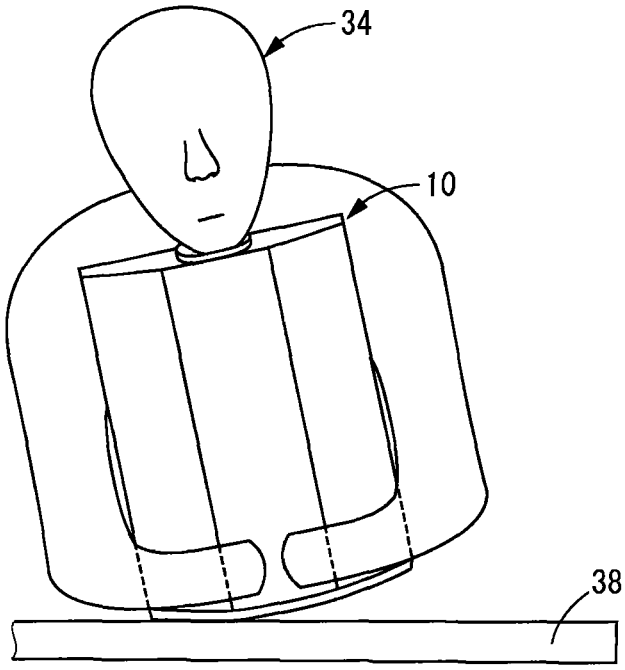
[FIG. 7] Front view illustrating yet another a method of using the posture-correcting exercise device of the embodiment.

When as depicted in FIG. 6 the posture-correcting exercise device 10 is tilted forward from the state depicted in FIG. 4, the second outwardly convex curving face 28 on the setting face 24 of the posture-correcting exercise device 10 will come into contact against the top of the desk 38, thereby further stretching the spine. If from this state the posture-correcting exercise device 10 is now tilted so as to pivot by equal angles to the left and right along the second outwardly convex curving face 28 as depicted in FIG. 7, the abdominal muscles and the back muscles on the left and right side must be used alternately in balanced fashion in order to keep the posture-correcting exercise device 10 tilted so as to pivot to the left and the right along the second outwardly convex curving face 28. It will be possible thereby to attain good left-right balance of the abdominal muscles and the back muscles. The muscles necessary to maintain correct spinal posture will be trained as a result, making it possible to correct spinal distortion (particularly lateral spinal curvature), as well as reducing the load on the spine. Additionally, it will be possible to achieve the effect of stretching the spine, the abdominal muscles, and the back muscles. FIG. 7 depicts the user 34 tilting the posture-correcting exercise device 10 to the right side.

As noted, the posture-correcting exercise device 10 of this embodiment can be used to correct slouch (hunched back); it can also be used to correct lordosis. In this case, as depicted in FIG. 8 the user 34 first sits in the chair 36 facing the desk 38, with the flat face 30 on the setting face 24 of the posture-correcting exercise device 10 positioned on the top of the desk 38 such that the narrow face 14 (specifically, the second outwardly convex curving face 28) is situated on the near side (towards the user 34), places his or her chin against the lower face of the recess 20 via the pad 22.

Figure 8:
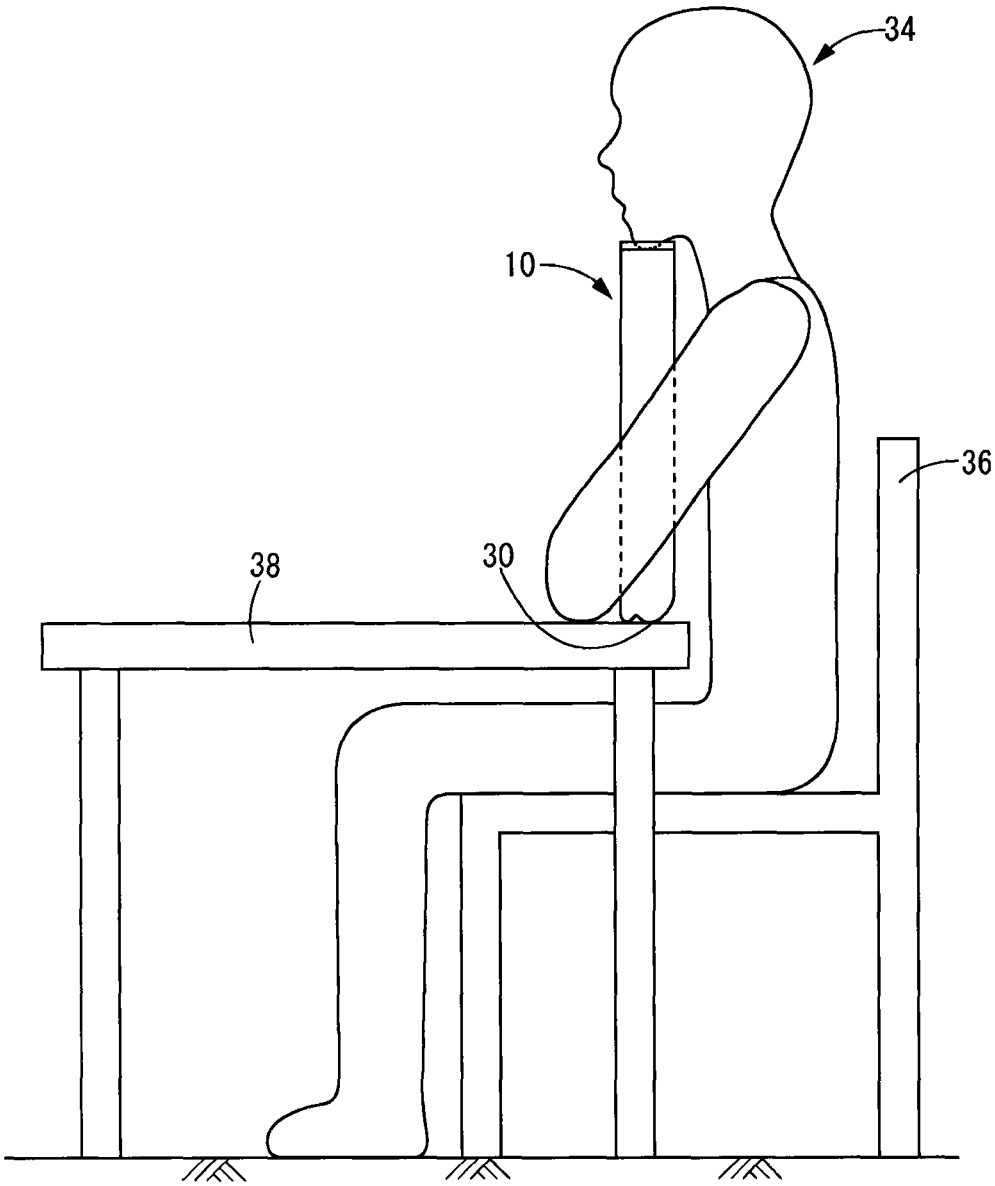
[FIG. 8] Side view illustrating a method of using the posture-correcting exercise device of the embodiment.
Figure 9:
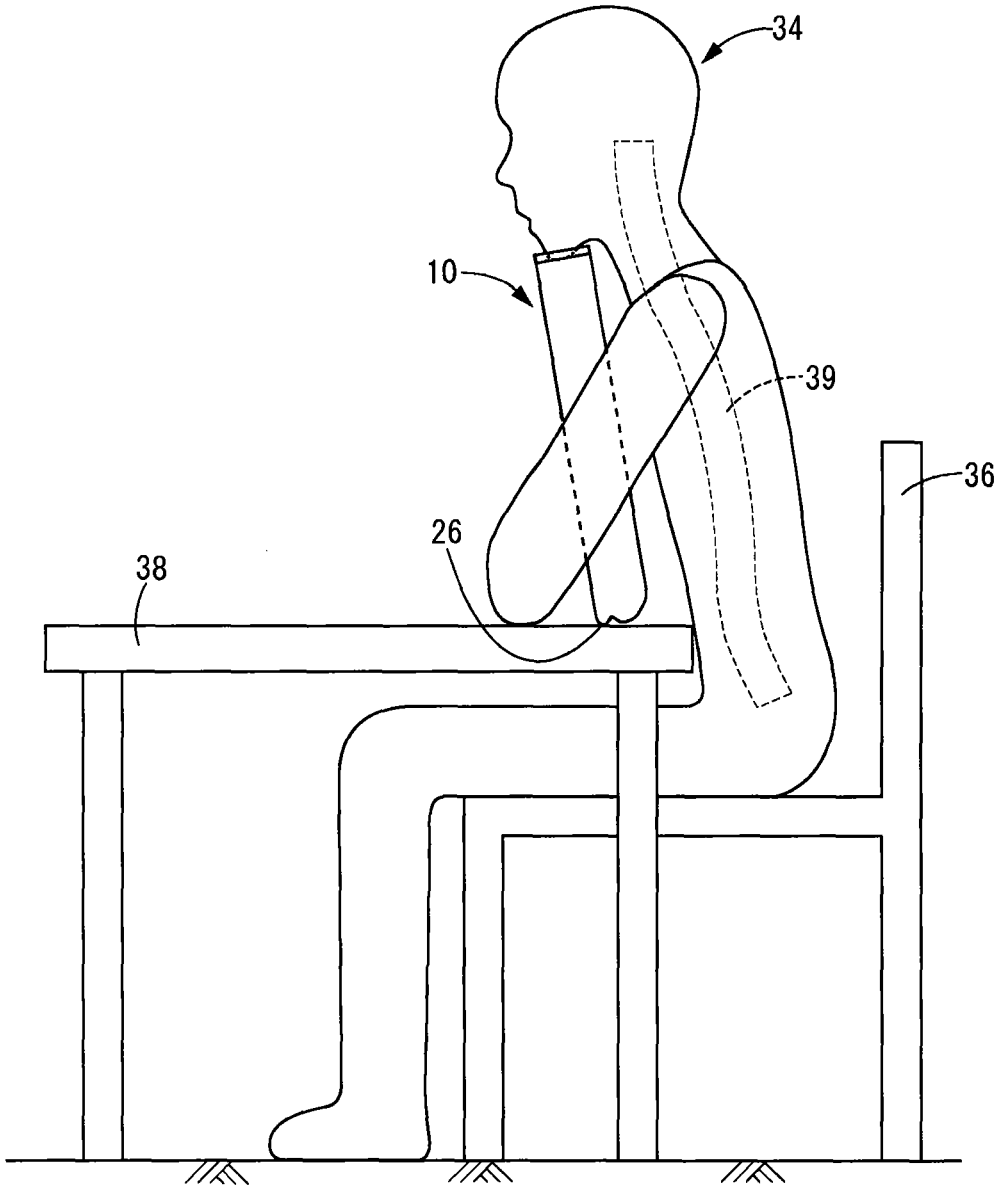
[FIG. 9] Side view illustrating another method of using the posture-correcting exercise device of the embodiment.

Then, with the first outwardly convex curving face 26 positioned situated on the opposite side (the side opposite from the user 34) and with the user 34 maintaining a posture with the chin resting against the lower face of the recess 20 via the pad 22 as depicted in FIG. 8, if the user now tilts the posture-correcting exercise device 10 towards the opposite side (forward), the first outwardly convex curving face 26 on the setting face 24 of the posture-correcting exercise device 10 will come into contact against the top of the desk 38 as depicted in FIG. 9. The user 34 will thereby assume a posture with the abdomen tucked in. As a result, the back, which had become rounded owing to curving of the spinal column 39 such that the lumbar region is overly convex anteriorly, will be corrected to its correct position to attain the natural gentle S shaped curve of the spine.

With the posture-correcting exercise device 10 tilted forward as depicted in FIG. 9, the necessary muscles to support the natural shape of the spine must be used in order to maintain the posture-correcting exercise device 10 in a forward-tilted state, whereas with the posture-correcting exercise device 10 not tilted (i.e. in the upright position) as depicted in FIG. 8, the device may be used without concentration on the necessary muscles to support the natural shape of the spine.

Consequently, through repeated forward tilting of the posture-correcting exercise device 10 and returning it to the original upright position, the user 34 will be able to repeatedly tense and relax the necessary muscles to support the natural shape of the spine, and the necessary muscles to support the natural shape of the spine will be trained as a result, making it possible to attain correct posture with the ear hole, the center of the shoulder, and the ankle aligned on a straight line when standing up. Additionally, through such training of the necessary muscles to support the natural shape of the spine, it will be possible to reduce the load on the spine.

Figure 10:
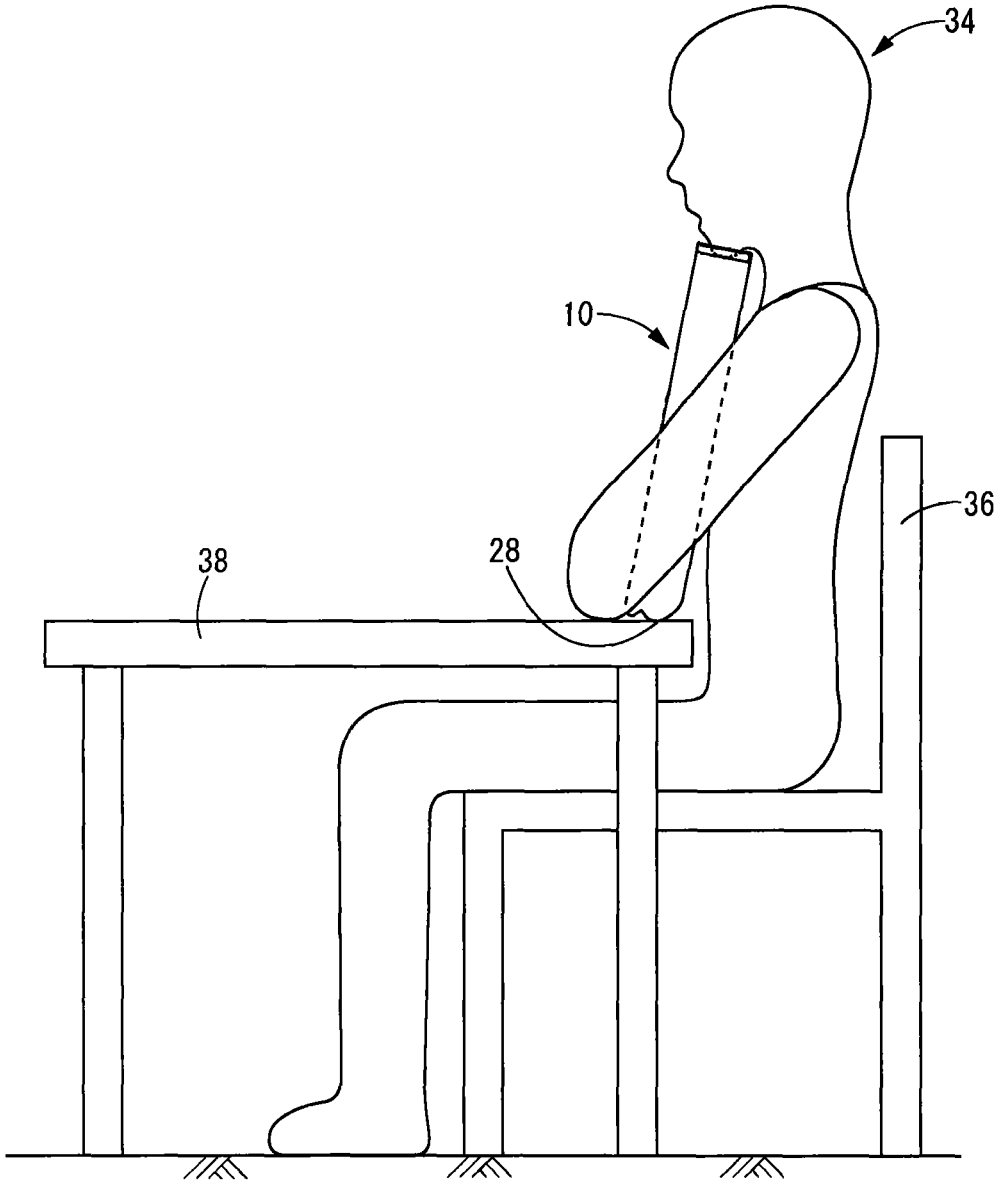
[FIG. 10] Side view illustrating yet another a method of using the posture-correcting exercise device of the embodiment.

When as depicted in FIG. 10 the posture-correcting exercise device 10 is tilted rearward from the state depicted in FIG. 8, the second outwardly convex curving face 28 on the setting face 24 of the posture-correcting exercise device 10 will come into contact against the top of the desk 38, and the user 34 will recurve his or her body. If from this state the posture-correcting exercise device 10 is now tilted so as to pivot by equal angles to left and right along the second outwardly convex curving face 28 in the same manner as depicted in FIG. 7, the abdominal muscles and the back muscles on the left and right side will be used alternately in balanced fashion in order to keep the posture-correcting exercise device 10 tilted so as to pivot to the left and the right along the second outwardly convex curving face 28. It is possible thereby to attain good left-right balance of the abdominal muscles and the back muscles. The muscles necessary to maintain correct spinal posture will be trained as a result, making it possible to correct spinal distortion (particularly lateral spinal curvature), as well as reducing the load on the spine. Additionally, it will be possible to achieve the effect of stretching the spine, the abdominal muscles, and the back muscles.

Moreover, in the posture-correcting exercise device 10 of this embodiment, the dimension in the height direction (lengthwise direction) is sufficiently larger than the dimension in directions orthogonal to the height direction (the width direction and the thickness direction), making it possible for the user grasp the posture-correcting exercise device 10 with the hands or tuck it between both arms while performing exercises by tilting the posture-correcting exercise device 10 in the above manner. As a result, it will be possible to achieve greater stability of movement of the posture-correcting exercise device 10 during exercises using the posture-correcting exercise device 10, making it possible for the user 34 to use the posture-correcting exercise device 10 without fear of potentially worsening one's condition, or of injury resulting from loss of balance.

Furthermore, in the posture-correcting exercise device 10 of this embodiment, owing to formation of the slot 32 on the setting face 24, in the event that for example, the posture-correcting exercise device 10 should inadvertently slip and begin to fall from the desk 38 during tilting of the posture-correcting exercise device 10 towards the user 34 from the upright state at the edge of the desk 38, the slot 32 will catch on the corner of desk 38, preventing an accident.

Furthermore, as no reaction motion is required when using the posture-correcting exercise device 10 of the embodiment in order to train the muscles required to support the spine in a state of natural curvature, it will be possible to avoid putting a load on the afflicted region of the spine.

As will be apparent from the discussion above, in this embodiment, the tilting face is defined by the first outwardly convex curving face 26 and the second outwardly convex curving face 28. Also, in this embodiment, the second outwardly convex curving face 28 constitutes the curving outside peripheral edge.

Figure 11:
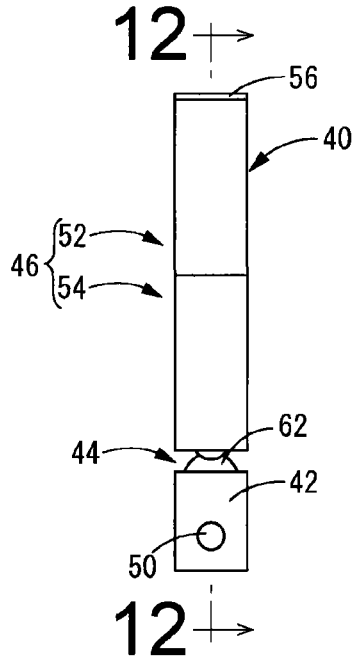
[FIG. 11] Side view depicting a posture-correcting exercise device according to a second embodiment of the present invention.
Figure 12:
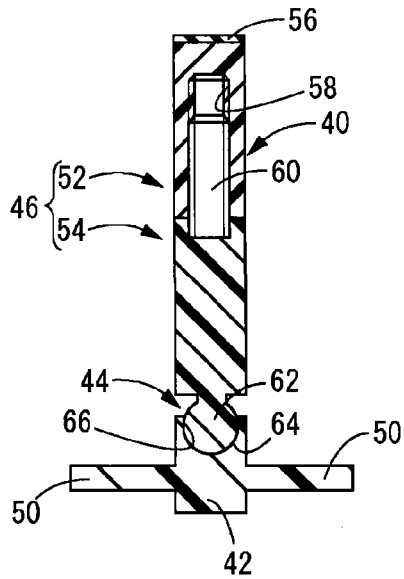
[FIG. 12] Sectional view taken along line 12-12 in FIG. 11.

Next, a posture-correcting exercise device 40 according to a second embodiment of the present invention will be described. As depicted in FIGS. 11 and 12, the posture-correcting exercise device 40 of this embodiment has a design provided with a rod 46 that is linked by a ball joint 44 to a stand 42 positioned on the desk.

To describe in detail, the stand 42 is of generally oblong block shape, and in it is a recess 48 having a generally spherical inside face 66 and formed opening upward. In this embodiment, the stand 42 is made of synthetic resin material such as polyacetal or polyurethane.

A pair of handles 50, 50 serving as grip portions project out from the stand 42. In this embodiment, the handles 50 are of round bar shape.

Meanwhile, the rod 46 is constituted of a first rod constituent member 52 and a second rod constituent member 54. In this embodiment, the first rod constituent member 52 and the second rod constituent member 54, like the stand 42, are both made of synthetic resin material such as polyacetal or polyurethane.

The first rod constituent member 52 has a design in which a rubber pad 56 is bonded to a first axial end face, while a screw hole 58 opens onto the other axial end face. The second rod constituent member 54 has a design in which a screw 60 projects out from a first axial end face, while a spherical portion 62 projects out from the other axial end face. The screw 60 may be embedded within the second rod constituent member 54 during the process of molding the second rod constituent member 54; or a hole may be made in the second rod constituent member 54, and [the screw 60] attached by being inserted in the hole and bonded therein.

The first rod constituent member 52 and the second rod constituent member 54 of the above designs are connected by screwing the screw 60 which has been provided to the second rod constituent member 54 into the screw hole 58 which has been provided to the first rod constituent member 52, to assemble the rod 46.

The rod 46 composed of the first rod constituent member 52 and the second rod constituent member 54 connected in this way is now linked to the stand 42 by force fitting the spherical portion 62 which has been provided to the second rod constituent member 54 into the recess 48 that has been formed in the stand 42, so that it becomes engaged therein. With the spherical portion 62 engaged in the recess 48 in this way, the surface 64 of the spherical portion 62 is disposed in sliding contact against the inside face 66 of the recess 48. Through this arrangement, the rod 46 is tiltable with respect to the stand 42. That is, in this embodiment, the tilting face is constituted by the surface 64 of the spherical portion 62, and this tilting face in turn constitutes the setting face.

The posture-correcting exercise device 40 having the design discussed above is used by a user sitting in a chair, by resting the chin on the pad 56 while grasping the handles 50, 50 that have been provided to the stand 42 which is positioned on a desk. That is, in this embodiment, the design of the chin rest portion includes the pad 56.

By designing the rod 46 to be tiltable with respect to the stand 42, it will be possible to achieve effects analogous to the first embodiment.

In this embodiment, since the posture-correcting exercise device 40 is used with the user grasping the handles 50, 50, it will be possible to stabilize the posture-correcting exercise device 40 during use.

Furthermore, in this embodiment, since the rod 46 is assembled by screwing the screw 60 which has been provided to the second rod constituent member 54 into the screw hole 58 which has been provided to the first rod constituent member 52, it will be possible to vary the length of the rod 46 by changing the extent to which the screw 60 is threaded into the screw hole 58. By so doing it will be possible to advantageously adapt to different user physique, methods of use, and so on. That is, in this embodiment, the height adjustment mechanism is constructed including the screw hole 58 and the screw 60.

Figure 13:
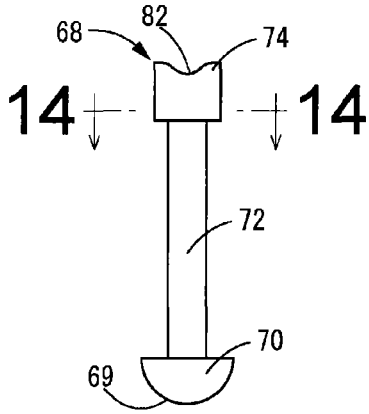
[FIG. 13] Side view depicting a posture-correcting exercise device according to a third embodiment of the present invention.
Figure 14:
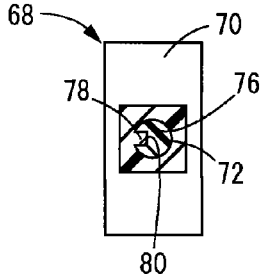
[FIG. 14] Sectional view taken along line 14-14 in FIG. 13.

Next, a posture-correcting exercise device 68 according to a third embodiment of the present invention will be described. As depicted in FIGS. 13 and 14, this posture-correcting exercise device 68 has a design in which a support post 72 of round post shape extends upright from a base 70 whose bottom face 69 is an arcuate curving face; as the chin rest portion, a detachable chin rest 74 is provided at the upper end of the support post 72. Specifically, as depicted in FIG. 14, the chin rest 74 is attached to the top end of the support post 72 by fitting the upper end section of the support post 72 into an insertion hole 76 that opens onto the bottom face of the chin rest 74. In this embodiment in particular, a mating projection 78 which projects inward in the axis-perpendicular direction from the inside peripheral wall of the insertion hole 76 fits into a mating slot 80 that has been formed in the upper end section of the support post 72 so that the chin rest 74 is attached in a positioned state with respect to the support post 72. In this embodiment, a slot 82 having a curving inside face is formed on the upper face of the chin rest 74, with the recess being constituted by this slot 82.

The posture-correcting exercise device 68 of this embodiment having the design described above enables contact against a desk or the like at the bottom face 69 of the base 70, and thus like the first embodiment affords effects comparable to known conventional traction. Moreover, since the device is tiltable at the bottom face 69 of the base 70, as with the first embodiment it will be possible to correct hunch or lordosis and position the spine correctly, while at the same time training the necessary muscles for maintaining the spine in the correct position, to reduce the load on the spine.

In this embodiment, since the chin rest 74 is detachable from the support post 72, it will be possible to exchange the chin rest 74 in order to adapt the device to different user physique, methods of use, and so on.

Figure 15:
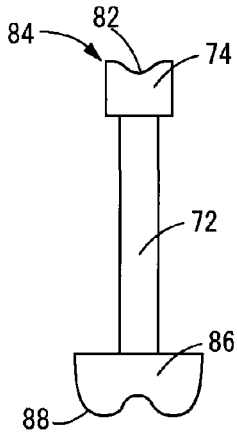
[FIG. 15] Side view depicting a posture-correcting exercise device according to a fourth embodiment of the present invention.

Next, a posture-correcting exercise device 84 according to a fourth embodiment of the present invention will be described with reference to FIG. 15. Since the posture-correcting exercise device 84 of this embodiment differs from the posture-correcting exercise device (68) of the third embodiment only in terms of the shape of its base 86, in the drawing parts apart from the base 86 have been assigned the same symbols as in the third embodiment, and these parts are not discussed in any detail.

The base 86 employed in the posture-correcting exercise device 84 of this embodiment has a bottom face 88 that inflects with generally "W" shape contours in side view, i.e. a wavy bottom face 88 whose two convexly curved portions contact at their apical points a desk etc. on which the posture-correcting exercise device 84 has been placed. As a result, the posture-correcting exercise device 84 of the embodiment will be able to maintain a stable upright position when placed on a desk etc. In this embodiment, the setting face is constituted by the bottom face 88, and tilting faces are respectively constituted by the curving sections of the widthwise edges of the base 86 on the bottom face 88.

The posture-correcting exercise device 84 of this embodiment having the design described above enables contact against a desk or the like at the bottom face 88 of the base 86, and thus like the first embodiment affords effects comparable to known conventional traction. Moreover, since the device is tiltable at the bottom face 88 of the base 86, as with the first embodiment it will be possible to correct hunch or lordosis and position the spine correctly, while at the same time training the necessary muscles for maintaining the spine in the correct position, to reduce the load on the spine.

Figure 16:
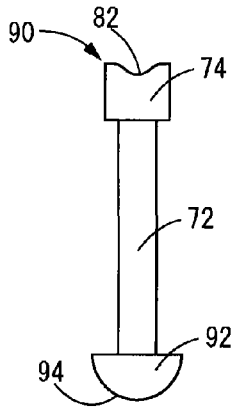
[FIG. 16] Side view depicting a posture-correcting exercise device according to a fifth embodiment of the present invention.
Figure 17:
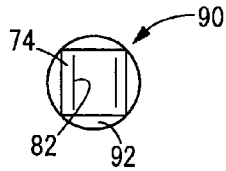
[FIG. 17] Top view of the posture-correcting exercise device.

Next, a posture-correcting exercise device 90 according to a fifth embodiment of the present invention will be described with reference to FIGS. 16 and 17. Since the posture-correcting exercise device 90 of this embodiment differs from the posture-correcting exercise device (68) of the third embodiment only in terms of the shape of its base 86, in the drawing parts apart from the base 86 have been assigned the same symbols as in the third embodiment, and these parts are not discussed in any detail.

The base 92 employed in the posture-correcting exercise device 90 of this embodiment has a semispherical shape, and the entirety of the spherical face that constitutes the bottom face 94 functions as both the setting face and the tilting face.

The posture-correcting exercise device 90 of this embodiment having the design described above enables contact against a desk or the like at the bottom face 94 of the base 92, and thus like the first embodiment affords effects comparable to known conventional traction. Moreover, since the device is tiltable at the bottom face 94 of the base 92, it will be possible to correct hunch or lordosis and position the spine correctly, while at the same time training the necessary muscles for maintaining the spine in the correct position, to reduce the load on the spine.

Figure 18:
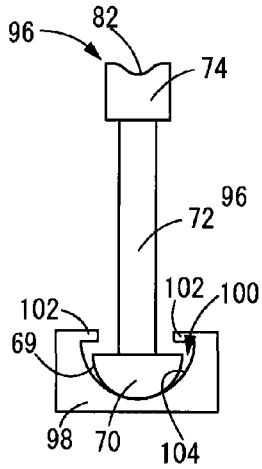
[FIG. 18] Side view depicting a posture-correcting exercise device according to a sixth embodiment of the present invention.

Next, a posture-correcting exercise device 96 according to a sixth embodiment of the present invention will be described with reference to FIG. 18. Since the posture-correcting exercise device 96 of this embodiment has a design that includes, in addition to the posture-correcting exercise device (68) of the third embodiment, a separate support stand 98, in the drawing parts apart from the support stand 98 have been assigned the same symbols as in the third embodiment and are not discussed in any detail.

The support stand 98 employed in this embodiment is made of steel or other material of relatively high specific gravity, and has oblong block shape overall. A recess 100 of slot shape extending in a straight line with U-shaped cross section is formed so as to open onto the upper face and at the two side faces. In this embodiment, stopper pieces 102, 102 that project inward in the width direction of the slot are disposed at the upper opening of the slot-shaped recess 100; in this embodiment in particular, the stopper pieces 102, 102 are formed to extend along the entire length of the recess 100 (the direction perpendicular to the plane of the page). By then sliding the base 70 from a side opening to a position housed within the recess 100, the bottom face 69 of the base 70 can be disposed in tiltable contact against the inside face 104 of the recess 100.

The posture-correcting exercise device 96 having the design described above is intended to be used with the support stand 98 positioned on a desk or the like, and with the user seated in a chair, etc. Since the bottom face 69 of the base 70 is disposed in contact against the inside face 104 of the recess 100, as with the first embodiment there are afforded effects comparable to known conventional traction. Moreover, since the bottom face 69 of the base 70 is tiltable with respect to the inside face 104 of the recess 100, it will be possible to correct hunch or lordosis and position the spine correctly, while at the same time training the necessary muscles for maintaining the spine in the correct position, to reduce the load on the spine.

In this embodiment, due to provision of the stopper pieces 102, 102 the range of allowable motion of the base 70, that is, the range of allowable tilt of the posture-correcting exercise device 96, will be limited through contact of the base 70 against the stopper pieces 102. By so doing it will be possible to prevent excessive tilting of the posture-correcting exercise device 96 during exercise using the posture-correcting exercise device 96, and to stabilize conditions of tilting of the posture-correcting exercise device 96.

Moreover, in this embodiment, since heavy weight of the support stand 98 is assured, it will be possible to advantageously prevent the support stand 98 from shifting when the posture-correcting exercise device 96 is tilted. As a result, it will be possible to stabilize conditions of tilting of the posture-correcting exercise device 96 during exercise using the posture-correcting exercise device 96.

While the present invention has been shown herein through certain preferred embodiments, these are intended as merely illustrative, and the invention should in no way be construed as limited to the specific disclosure of the embodiments herein.

For example, in the first embodiment, the second outwardly convex curving face 28 will not always be needed. Nor will the recess 20 or the pad 22 always be needed in the first embodiment. Where no recess 20 has been provided, the user will ascertain the center of the narrow face 14 that has been formed in the widthwise center section of the posture-correcting exercise device 10 in order to ascertain the location at which to rest the chin. In the first embodiment, the curving sloped faces 12 could be replaced by flat sloped faces. In the first embodiment, the slot 32 will not will not always be needed. Also, the shape of the slot 32 in the first embodiment is not limited to one extending with V-shaped cross section; a shape extending with a oblong cross section or U-shaped cross section would be acceptable as well.

In the second embodiment above, the handles 50, 50 may be provided to the first rod constituent member 52 or to the second rod constituent member 54.

In the third to fifth embodiments above, the mating slot 80 and the mating projection 78 will not always be needed.

In the fourth embodiment above, the number of convexly curving sections provided on the bottom face 88 may be three or more.

Furthermore, in the sixth embodiment above, the stopper pieces 102, 102 will not always be needed. The range of allowable tilt of the posture-correcting exercise device 96 may be limited through contact of the support post 72 against the stopper pieces 102, 102. The slot-shaped recess 100 may extend in a straight line with an oblong cross section. The recess may be of perforated form. The material for the support stand is not limited to high specific gravity materials such as steel, and may be formed of synthetic resin for example. In this case, it will be preferable to ensure sufficient weight of the support stand by making the support stand hollow and filling it with water, sand, gravel, or the like so as to make it possible to stabilize the support stand.

The shape and design of the posture-correcting exercise device is not limited to those described in the first to sixth embodiments above.

It is also to be understood that the present invention may be embodied in other ways not enumerated herein, with various changes, modifications and improvements which may occur to those skilled in the art, without departing from the spirit and scope of the invention.

The invention claimed is:

1. A posture-correcting exercise device comprising:

a chin-rest portion at an upper end face of the posture-correcting exercise device upon which a user rests a chin; and a setting face at a lower end face of the posture-correcting exercise device, wherein an outer periphery of the setting face defines a tilting face of curved shape so that the user is able to tilt at the setting face with the chin resting on the chin-rest portion, wherein a flat face is formed in a center section of the setting face, the flat face being parallel to the upper end face, wherein the chin-rest portion comprises a recess for accommodating the chin of the user and is formed in or on the upper end face, wherein the recess faces a direction perpendicular to (a) a plane in which the flat face sits and (b) a plane in which the upper end face sits, wherein the posture-correcting exercise device is formed of a rigid, inflexible material, and wherein the posture-correcting exercise device includes a length from the chin-rest portion to the setting face, the length configured to allow the user of the posture-correcting exercise device to support the user's chin at the chin-rest portion while stretching the user's spine while the user sits in a chair with the posture-correcting exercise device supported by a desk at the flat face.

2. The posture-correcting exercise device according to claim 1, wherein the outer periphery of the setting face is curved with beveled contours so as to define the tilting face.

3. The posture-correcting exercise device according to claim 1, wherein the outer periphery of the setting face has a curving outside peripheral edge that is outwardly convex along a longitudinal direction of the setting face, with the curving outside peripheral edge defining the tilting face.

4. The posture-correcting exercise device according to claim 3, wherein the curving outside peripheral edge is formed over a length no more than halfway in a circumferential direction in the outer periphery of the setting face; and a straight outer periphery is formed so as to extend in a chord direction of the curving outside peripheral edge.

5. The posture-correcting exercise device according to claim 1, wherein a slot is formed so as to extend in a straight line on the setting face, the slot extending across an entire width of the posture-correcting exercise device.

6. The posture-correcting exercise device according to claim 1, further comprising a height adjusting mechanism for adjusting the vertical position of the chin-rest portion from the setting face.

7. The posture-correcting exercise device according to claim 1, wherein the chin-rest portion and the recess are positioned on a same center axis.

8. The posture-correcting exercise device according to claim 1, wherein an exterior surface of the setting face is formed of a material having sufficient slip resistance to prevent slipping of the posture-correcting exercise device while the posture-correcting exercise device is being tilted on the setting face under pressure from the user's chin.

9. The posture-correcting exercise device according to claim 1, further comprising a grip portion for the user to grasp with the hands.

10. The posture-correcting exercise device according to claim 1, wherein a height dimension from the setting face to the chin-rest portion is larger than a dimension in all directions orthogonal to the height direction.

11. The posture-correcting exercise device according to claim 1, further comprising a separate support stand having a recess against which the setting face is positioned in tiltable contact.

12. The posture-correcting exercise device according to claim 1, wherein the posture-correcting exercise device is formed of a resin, a metal material, a wood material, or carbon fibers.

13. The posture-correcting exercise device according to claim 1, wherein the outer periphery of the setting face has a curving outside peripheral edge that is outwardly convex in a circumferential direction, with the curving outside peripheral edge defining the tilting face.

* * * * *